US008677627B2

(12) United States Patent
Li et al.

(10) Patent No.: US 8,677,627 B2
(45) Date of Patent: Mar. 25, 2014

(54) HAIR TRIMMER WITH ROTATABLE DETENTED HEAD

(75) Inventors: Five-Tiger Li, Ningbo (CN); Sam Zhang, Sterling, IL (US); Tiger Lou, Ningbo (CN); Bin Wang, Rock Falls, IL (US)

(73) Assignee: Wahl Clipper Corporation, Sterling, IL (US)

( * ) Notice: Subject to any disclaimer, the term of this patent is extended or adjusted under 35 U.S.C. 154(b) by 1063 days.

(21) Appl. No.: 11/648,515

(22) Filed: Dec. 29, 2006

(65) Prior Publication Data

US 2008/0155834 A1 Jul. 3, 2008

(51) Int. Cl.
*B26B 19/20* (2006.01)
*B26B 19/02* (2006.01)

(52) U.S. Cl.
USPC ..... 30/43; 30/43.91; 30/43.92; 30/194

(58) Field of Classification Search
USPC ..... 30/216, 43.92, 199, 228, 194, 43.91, 30/210, 215, 223, 196, 43
See application file for complete search history.

(56) References Cited

U.S. PATENT DOCUMENTS

| | | | | | |
|---|---|---|---|---|---|
| 1,997,096 | A | * | 4/1935 | Andis | 30/199 |
| 3,217,409 | A | | 11/1965 | Proffitt | |
| 3,999,295 | A | * | 12/1976 | Du Bois | 30/195 |
| 4,332,321 | A | * | 6/1982 | Wratschko | 206/228 |
| 4,617,736 | A | * | 10/1986 | McCrary | 30/169 |
| 4,688,329 | A | | 8/1987 | Oord | |
| 5,020,281 | A | * | 6/1991 | Neff | 451/358 |
| 5,165,172 | A | | 11/1992 | Weinrauch | |
| 5,372,420 | A | * | 12/1994 | Van Deursen et al. | 366/129 |
| 5,579,581 | A | | 12/1996 | Melton | |
| 5,606,799 | A | * | 3/1997 | Melton | 30/216 |
| 5,970,616 | A | * | 10/1999 | Wahl et al. | 30/216 |
| 6,050,989 | A | * | 4/2000 | Fox et al. | 606/1 |
| D439,703 | S | | 3/2001 | Wagenknecht et al. | |
| 6,378,210 | B1 | | 4/2002 | Bickford | |
| 6,421,922 | B2 | * | 7/2002 | Beutel et al. | 30/216 |
| 6,502,312 | B2 | * | 1/2003 | Beutel et al. | 30/216 |
| 6,536,116 | B2 | * | 3/2003 | Fung | 30/199 |
| 6,742,262 | B2 | | 6/2004 | Rizzuto, Jr. et al. | |
| 6,886,255 | B2 | * | 5/2005 | Freas et al. | 30/43.91 |
| 7,481,135 | B2 | * | 1/2009 | Schoenbeck et al. | 81/177.7 |
| 2005/0097757 | A1 | | 5/2005 | McCambridge et al. | |
| 2005/0246902 | A1 | * | 11/2005 | Poran | 30/201 |
| 2006/0156880 | A1 | | 7/2006 | McCambridge et al. | |
| 2008/0301948 | A1 | * | 12/2008 | Kostner et al. | 30/42 |

FOREIGN PATENT DOCUMENTS

| | | | |
|---|---|---|---|
| EP | 0 176 128 | | 4/1986 |
| EP | 1 295 686 | A1 | 3/2003 |
| EP | 1 529 608 | A2 | 5/2005 |
| GB | 2 383 970 | A | 7/2003 |
| JP | S60-132265 | | 9/1985 |
| JP | S60-198184 | | 10/1985 |
| WO | WO 03/057432 | A1 | 7/2003 |
| WO | WO 2007/060590 | A2 | 5/2007 |
| WO | WO 2007/135553 | A2 | 11/2007 |

* cited by examiner

*Primary Examiner* — Omar Flores Sanchez
(74) *Attorney, Agent, or Firm* — Greer, Burns & Crain, Ltd.

(57) ABSTRACT

A hair trimmer includes a handle having a housing including an actuation assembly rotatable relative to the housing, and a blade assembly including a reciprocating blade, a stationary blade and a blade assembly housing, the blade assembly constructed and arranged for being detachably engaged to the actuation assembly in a plane of rotation of the actuation assembly.

6 Claims, 7 Drawing Sheets

HAIR TRIMMER WITH ROTATABLE DETENTED HEAD

BACKGROUND OF THE INVENTION

The present invention generally relates to an electric hair cutting device such as a trimmer or a hair clipper. More particularly, the present invention relates to an electric hair cutting device having a detachable and rotatable blade assembly.

Electric hair trimmers or clippers are commonly used by stylists, barbers, or individuals for styling hair, and typically include a handle having a housing for enclosing a motor and a blade assembly associated with the handle. The blade assembly is generally fixed to the handle at a certain orientation for receiving driving power from the motor. A bladeset in the blade assembly includes a stationary blade and a moving blade reciprocating laterally and substantially parallel relative to the stationary blade to provide a scissors-type cutting action.

One problem incurred when using current hair trimmers is orienting the trimmer to reach areas that are difficult to cut, such as behind the ears or the nape of the neck. In these situations, the entire trimmer must generally be maneuvered to change the orientation of the blades and reach the area to be cut. Such movement is awkward, and often causes discomfort to the user's wrist or hand after continued use, and also decreases the accuracy and/or efficiency of the trimmer because the blades may not be entirely in contact with the cutting area.

To attempt to resolve this problem, hair trimmers were developed having heads rotatable relative to the handle, such as commonly owned U.S. Pat. No. 5,970,616 to Wahl et al., which discloses a hair trimmer having a lighted rotating head. In Wahl, a cutting surface extends at an angle from a blade housing that is rotatable with respect to a main body of the hair trimmer. An interface plane is defined between the main body and the blade housing, and is arranged at an oblique angle relative to a longitudinal axis of the main body. Although this arrangement provides the user with added comfort, especially during beard trimming alternately using both hands, due to the angle of the blade housing relative to the longitudinal axis of the main body, it can still be difficult to efficiently reach and cut other hard to trim areas.

To address this problem, a hair trimmer with a rotatable and pivotable blade assembly was developed, seen in commonly-owned U.S. Pat. Nos. 5,579,581 and 5,606,799 to Melton. In Melton, a handle portion is detachably connected to a blade assembly by a ball-and-socket connection, allowing the blade assembly to be easily detached without the need for additional tools. The ball-and-socket connection enables the blade assembly to rotate relative to the handle portion through 360°, as well as pivoting in a wide variety of positions, enabling the user to cut hard to reach areas. However, Melton does not provide a mechanism that secures or locks the blade assembly in a desired position. Accordingly, the blade assembly can move from the desired rotatable position during use, causing inaccurate trimming.

Yet another design criterion of current hair trimmers with rotatable blade assemblies is imbalance caused by operational vibrations. One source of imbalance is the use of only one attachment or locking point holding the blade assembly in position. Such imbalance reduces the cutting accuracy of the trimmer, and also causes user discomfort because of the resulting vibrations.

Accordingly, there is a need for an improved hair trimmer having a blade assembly that is rotatable and detachable through 360° relative to the handle, and which addresses the above-listed design factors. Further, there is a need for an improved hair trimmer that provides a stable and balanced attachment between the blade assembly and handle, and reduces the vibrations experienced by the user during operation.

BRIEF SUMMARY OF THE INVENTION

The present hair trimmer meets or exceeds all of the above-identified needs. Specifically, the present hair trimmer includes a blade assembly that can be rotated 360° relative to the handle of the trimmer. The rotation is controlled in that a designated number of releasably locked operational positions are available.

Further, in an alternate embodiment, the present hair trimmer includes an actuation assembly having a memory function that allows the blade assembly to be detached from the handle in one of the designated rotatable positions and reattached in the same designated position. This feature allows the user to exchange blade assemblies for different types of trimming and preserves the selected bladeset orientation.

Also, the present hair trimmer provides a plurality of attachment points between the blade assembly and the handle and is accordingly more stable and balanced than current hair trimmers, reducing the vibrations experienced by the user during operation.

More specifically, the present invention provides a hair trimmer including a handle having a housing including an actuation assembly rotatable relative to the housing, and a blade assembly including a reciprocating blade, a stationary blade and a blade assembly housing, the blade assembly constructed and arranged for being detachably engaged to the actuation assembly in a plane of rotation of the actuation assembly.

DETAILED DESCRIPTION OF THE INVENTION

Figure 1:
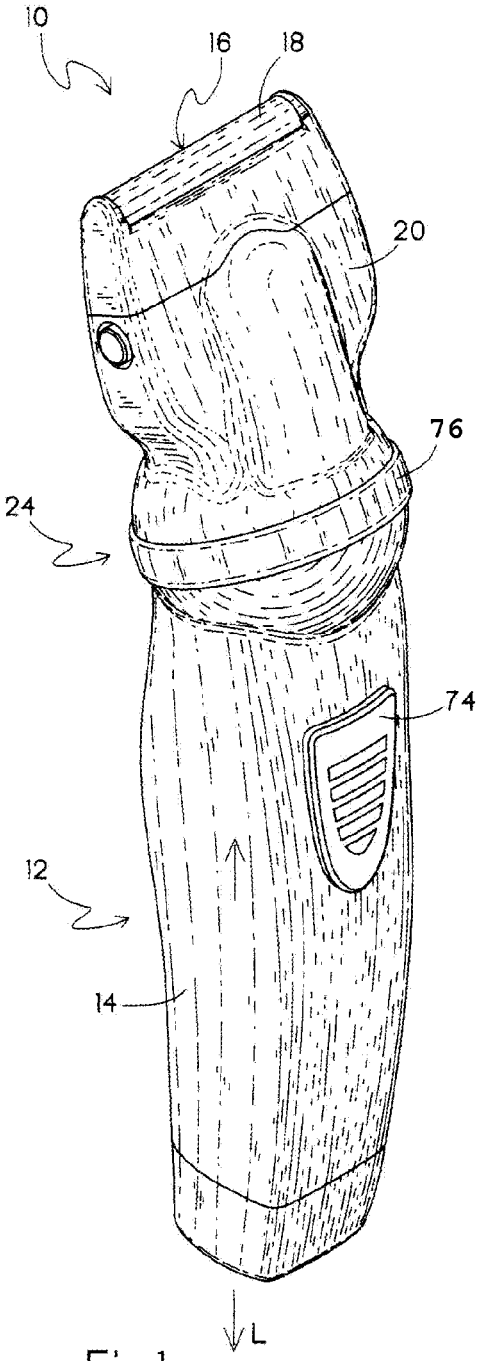
FIG. 1 is a front perspective view of a hair trimmer according to the present invention.

Referring to FIGS. 1-4, a hair cutting device, referred to here as a trimmer or clipper is generally designated 10, and includes a handle 12 having a housing 14. A feature of the present hair trimmer 10 is that the handle 12 is configured for accommodating a variety of hair cutting blade assemblies. These assemblies are designed for specific hair cutting tasks including, but not limited to shaving, general trimming, detail trimming and the like. A first blade assembly 16 is a shaver including a reciprocating blade (not shown), a stationary blade 18 here referenced to as a shaver foil, and a blade assembly housing 20. As known in the shaver art, the reciprocating blade moves transversely to the perforated foil 18 to obtain efficient cutting action.

Figure 1A:
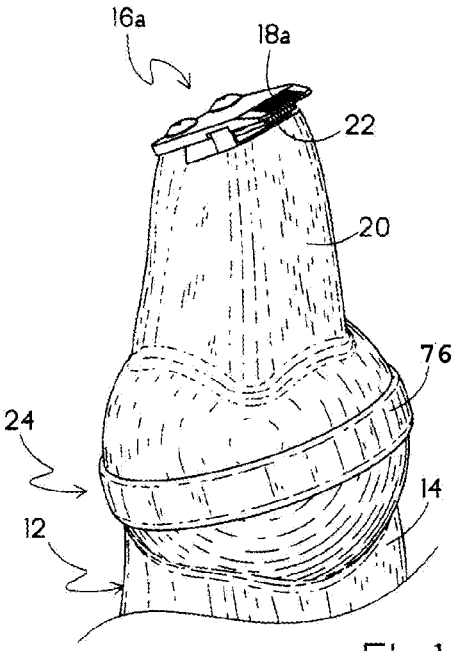
FIG. 1A is a top perspective view of an alternate embodiment of the blade assembly of FIG. 1.
Figure 2:
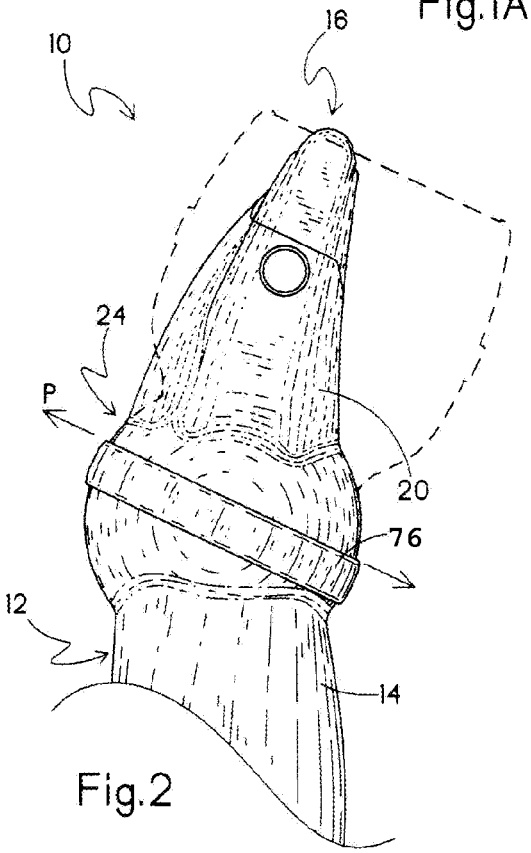
FIG. 2 is a fragmentary side view of the hair trimmer of FIG. 1 showing a blade assembly rotatable relative to a handle.
Figure 4:
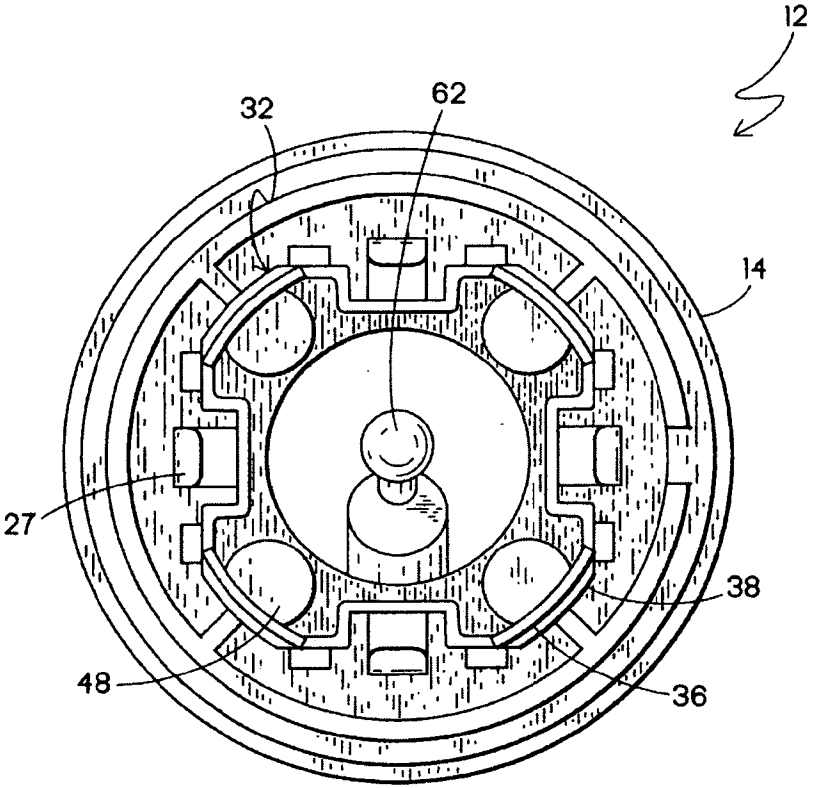
FIG. 4 is a top view of the actuation assembly of the hair trimmer.
Figure 3:
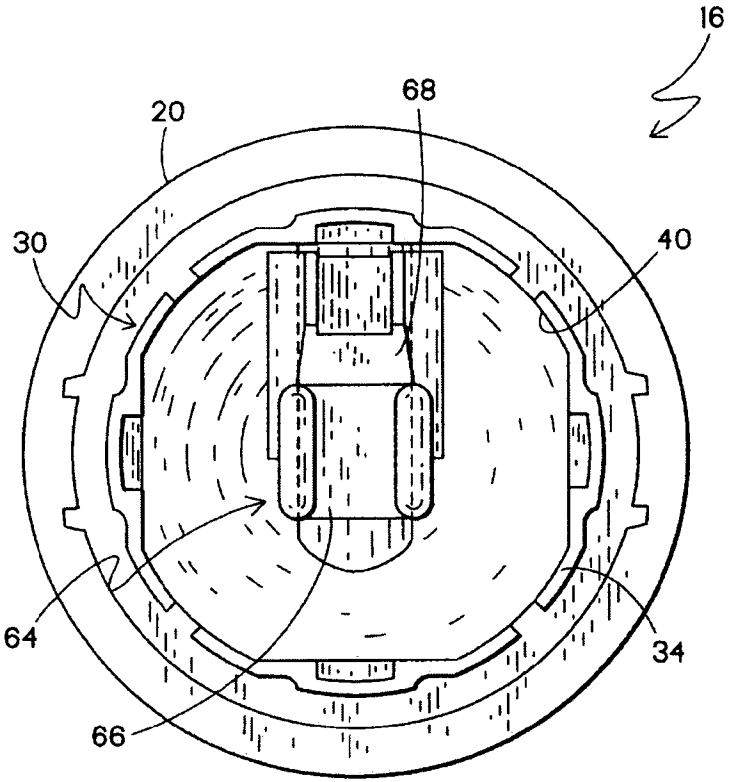
FIG. 3 is bottom view of the bladeset of the hair trimmer of FIG. 1.

Referring now to FIG. 1A, an alternate blade assembly is designated 16*a* and is designed for trimming. Shared or corresponding components with the assembly 16 are designated with identical reference numbers. As is known in the art, a reciprocating toothed blade 22 moves parallel relative to a stationary toothed blade 18*a* to create a scissors-type cutting action.

Both of the blade assemblies 16, 16*a* include the blade housing 20 that is constructed and arranged to releasably engage an actuation assembly 24. In the following discussion, when the assembly 16 is referred to, it will be understood that assembly 16*a* is referred to as well. A feature of the present trimmer 10 is that the actuation assembly 24 is rotatable relative to the housing 14 as described in greater detail below.

The blade assembly 16 is constructed and arranged for being detachably and rotatably engaged to the actuation assembly 24 in a plane of rotation P of the actuation assembly. It is contemplated that this arrangement is advantageous over current hair trimmers, because when rotated in the plane of rotation of the actuation assembly 24, the blade assembly 16 can more easily access difficult to trim areas than conventional blade assemblies, and the work area is more visible. Rather than being freely rotatable, as is known in the art, the present blade assembly 16 is indexed to rotate to specific designated, releasably locked positions. Another contemplated advantage of this arrangement is that it improves increased maneuverability of the blade assembly 16, reducing the stress on the hand or wrist of the user compared to current hair trimmers.

The housings 20 are generally manufactured from a lightweight, durable plastic, but it is appreciated that other materials with similar properties may be suitable, as known in the art.

Figure 5:
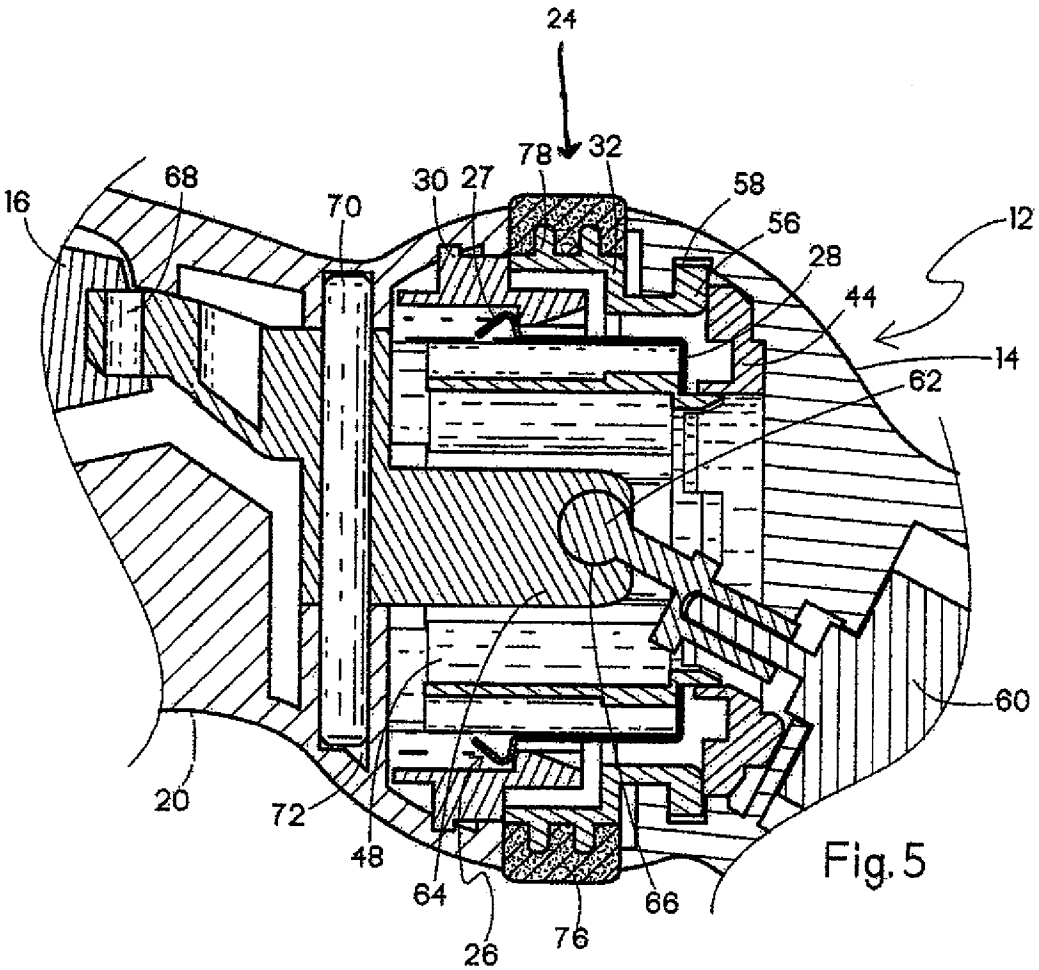
FIG. 5 is a fragmentary cross-sectional side view of the hair trimmer of FIG. 1 showing the attachment between the blade assembly and the handle.
Figure 6:
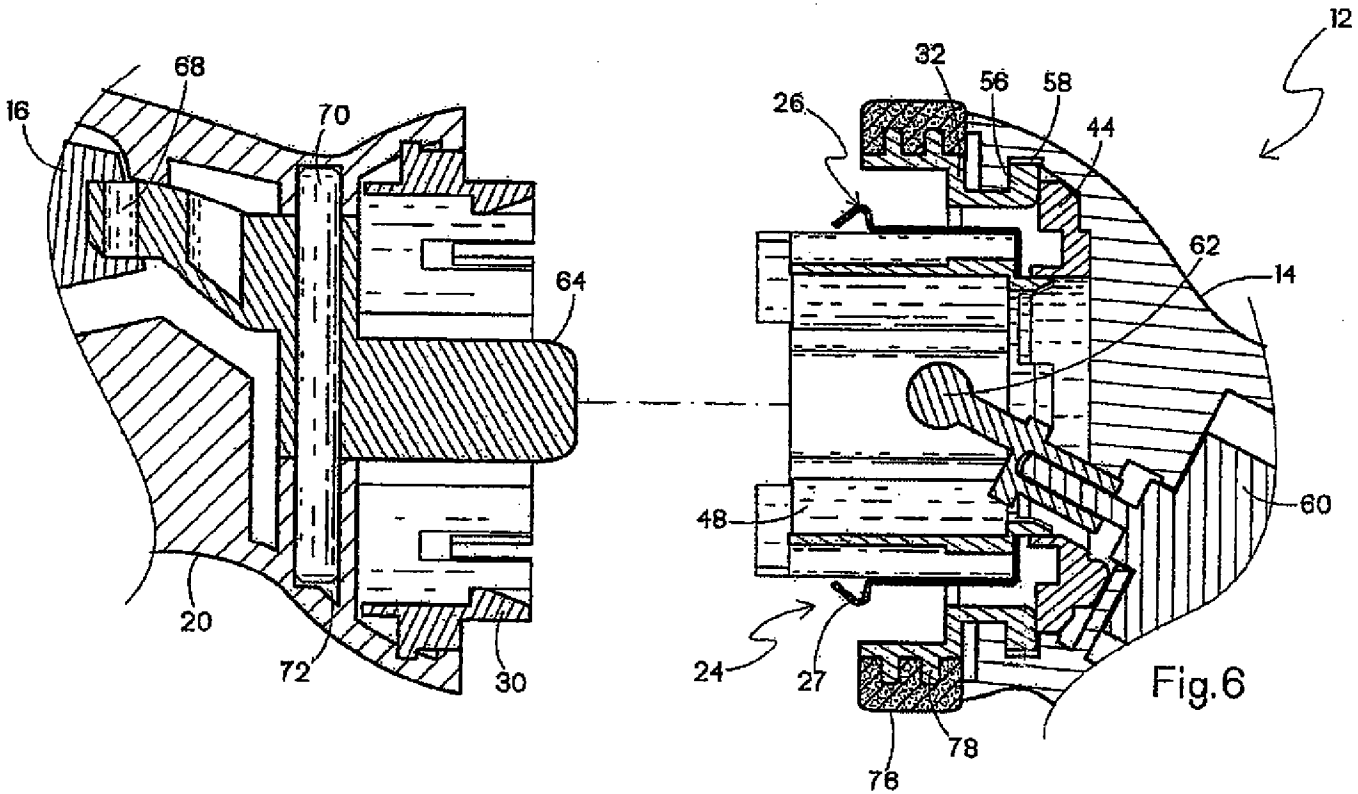
FIG. 6 is an exploded fragmentary cross-sectional side view of FIG. 5 showing the blade assembly detached from the handle.

Referring to now FIGS. 5 and 6, the handle 12 includes a least one spring clip 26 configured for removably securing the blade assembly 16 to the actuation assembly 24. Preferably, the spring clip 26 includes four elongate spring clip members 27 equally spaced and projecting normally from a generally circular ring 28 located within the actuation assembly 24. However, it is recognized that the spring clip 26 optionally includes an alternate number of spring clip members 27, such as two or three members, varying to suit the application. Preferably still, the spring clip members 27 are integrally formed with the ring 28, although it is appreciated that other configurations may be suitable. Preferably, the spring clip members 27 are manufactured from a lightweight, resilient metal, but it is appreciated that other materials with similar properties may be suitable. It is also recognized that the spring clip 26 and the spring clip members 27 are optionally integrally formed with the casing 32.

As shown in FIGS. 3-6, a generally octagonal frame 30 is provided in the blade housing 20 and surrounds a complimentary casing 32 on the actuation assembly 24 upon releasable attachment of the blade assembly 16 and the actuation assembly 24. However, it is appreciated that the frame 30 can be other shapes, depending on the application. The frame 30 is preferably manufactured from a lightweight, durable plastic, but it is appreciated that other materials with similar properties may be suitable. The frame 30 defines at least one and preferably a plurality of generally linear segments or channels 34 preferably forming an octagon, but as stated above, it is recognized that other shapes may be suitable. Each channel 34 is constructed and arranged to slidingly engage a corresponding tab 36 provided on the casing 32. The spring clip members 27 exert a radial outward biasing force, creating a hook-and-catch mechanism between the tabs 36 in the channels 34, holding the blade assembly 16 in place. In the preferred embodiment, there are four channels 34 and four tabs 36, so that an exterior surface 38 of the tabs 36 slidingly engages an interior surface 40 of the channels in one of four (preferably eight) positions. The orientation of the blade assembly 16 and the actuation assembly 24 channels 34 and tabs 36 is determined by at least one detent assembly 42. It is contemplated that this arrangement provides a relatively stable and balanced attachment between the blade assembly 16 and the handle housing 14 which is more secure than that found in current trimmers.

Referring to FIGS. 4-8, the actuation assembly 24 located on the handle 12 is generally circular when viewed from above and preferably includes a socket plate 44, the casing 32 and is constructed and arranged for accommodating the at least one detent assembly 42. Best seen in FIG. 8, the socket plate 44 is fixed to the handle 12 and is provided with a plurality of sockets 46. The sockets 46 are peripherally spaced about the annular socket plate 44. It is contemplated that the sockets 46 are equally spaced around the socket plate 44, and preferably include twelve sockets, each socket being arranged approximately 30° apart from corresponding adjacent sockets, although it is appreciated that other configurations may be suitable. Preferably, the spring ring 28 is located between the socket plate 44 and the casing 32 to prevent movement or dislodgement of the ring. The socket plate 44 and the casing 32 are preferably manufactured of a lightweight, durable plastic, but it is appreciated that other similar materials may be available.

Figure 7:
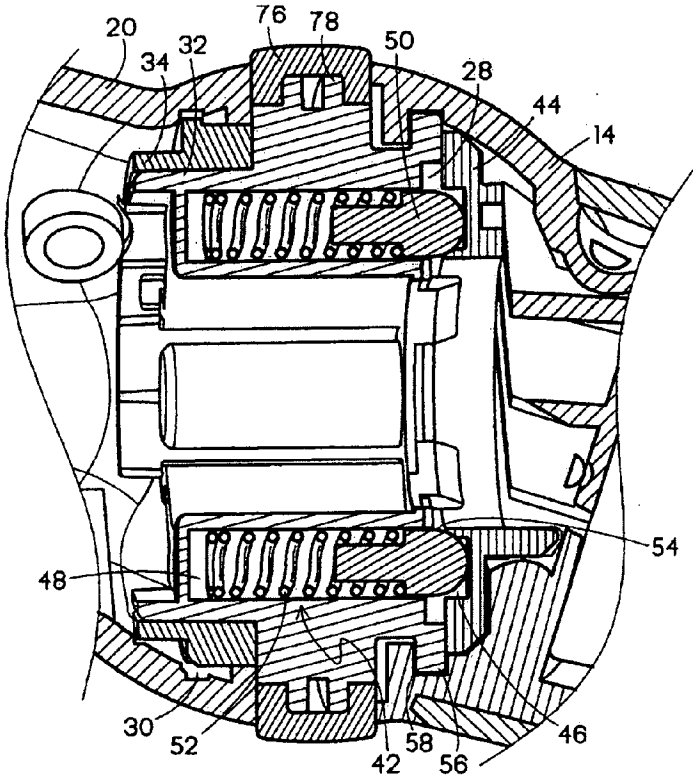
FIG. 7 is a cross-sectional view of the actuation assembly of the hair trimmer.

Referring now to FIG. 7, the casing 32 preferably includes at least one open-ended barrel 48 constructed and arranged for receiving a corresponding detent pin 50 and a corresponding spring 52, making up each detent assembly 42. Preferably, the barrel 48 is generally circular in cross-section and defines a cylindrical shape, although it is recognized that other configurations may be suitable.

Figure 8:
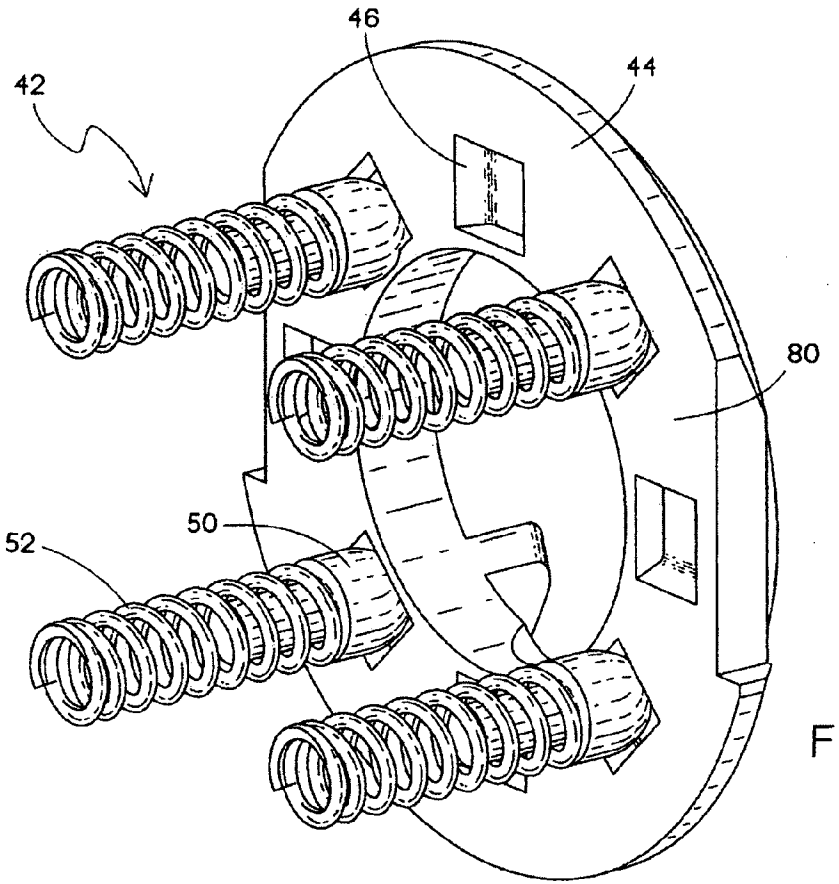
FIG. 8 is a front perspective view of at least one detent assembly engaging a socket plate of the hair trimmer according to the present hair trimmer.

Referring to FIGS. 7 and 8, each detent assembly 42 is arranged generally transverse to the plane of rotation P of the actuation assembly 24. Preferably, the at least one detent assembly 42 is arranged approximately perpendicularly relative to the plane of rotation, although it is appreciated that other angles may be suitable, depending on the application. Preferably still, the plane of rotation "P" is arranged at approximately a 15-45° angle relative to a longitudinal axis "L" of the handle 12. The spring 52 is constructed and arranged for biasing the pin 50 towards an open end 54 of the barrel 48 and into the corresponding socket 46. It is contemplated that the pin 50 is a Vlier pin, but it is recognized that other types of pins may be suitable, as known in the art. Preferably, there is at least one, more preferably two or more, and most preferably four detent assemblies 42 equally circumferentially spaced from each other at about 90° between the pins 50.

The casing 32 is rotatably held within the handle housing 14 by a radial flange 56 on the casing engaging an annular groove 58 in the housing. Also, the position of the casing 32 in the housing 14 secures the socket plate 44 in place (FIG. 7).

Since there are preferably twelve sockets 46 spaced approximately 30° from each other on the socket plate 44, and four detent assemblies 42, as the casing 32 is rotated relative to the socket plate there will be potentially twelve designated positions of the actuation assembly 24 relative to the handle housing 14. In view of the engagement of the blade assembly 16 with the actuation assembly 24, and more specifically the casing 32, it will be seen that there are twelve potential designated positions for the blade assembly relative to the housing 14.

Referring now to FIGS. 3-6, the hair trimmer handle 12 further includes a drive motor 60 with an eccentric drive member 62, and the blade assembly 16 includes a linkage 64 configured for engaging the drive member. The linkage 64 preferably defines a slot 66 configured for receiving the drive member 62, and a tongue 68 located opposite the slot and constructed and arranged for engaging the reciprocating blade 22. As is known in the art, a pivot pin 70 is fixed to the linkage and is pivotably held at each end in recesses 72 in the blade housing 20. In this manner, rotational motion of the motor 60 is converted to linear reciprocation. As is known in the art, the motor 60 is activated by a switch button 74 on the housing 14 (FIG. 1). It is contemplated that the configuration of the linkage 64 provides a stable and operationally secure connection between the motor 60 and the blade assembly 16. However, it is recognized that other configurations may be appropriate, as known in the art. The handle 12 further preferably includes a rechargeable battery (not shown) to facilitate cordless operation of the hair trimmer 10, as known in the art, although it is appreciated that corded operation is contemplated as well.

In operation, when the user wishes to rotate the blade assembly 16 relative to the handle 12, a resilient annular grip 76 is grasped. The grip 76 is fixed to a radial lip 78 on the casing 32. By grasping the grip 76, the casing 32, as well as the blade assembly 16 is rotatable in either the clockwise or counter-clockwise direction. This action causes the biased pins 50 to sequentially engage the sockets 46 and an interim upper surface 80 of the socket plate 44. As each socket is engaged, there is an audible and tactile indication. Once the pin 50 is in the designated socket 46, the blade assembly 16 becomes locked in position and can be operated in that location. It is contemplated that the present configuration is superior to many current hair trimmers because the detent assembly 42 is releasably, yet securely locked into the socket plate 44, and due to the presence of multiple (preferably four) detent assemblies, will not be displaced due to the operational vibrations experienced by the trimmer 10.

Figure 9:
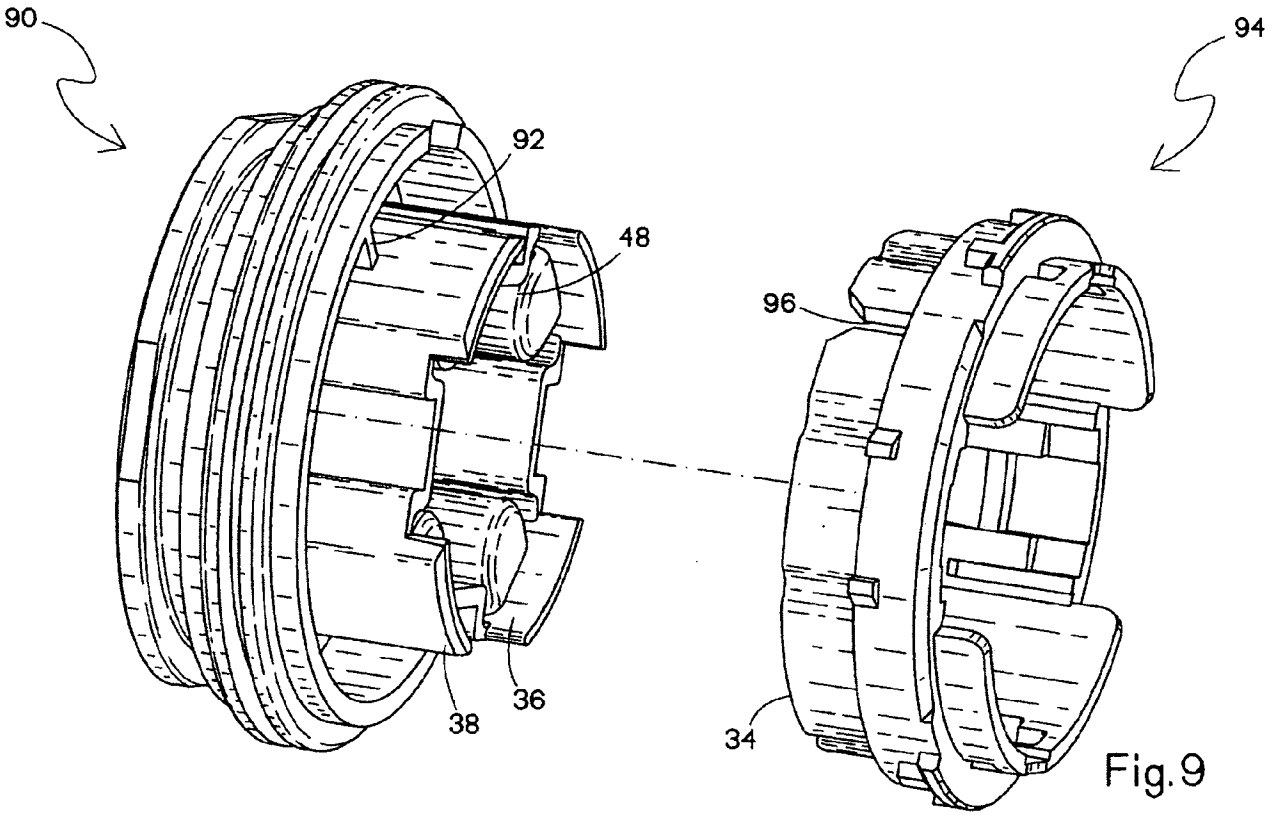
FIG. 9 is an exploded perspective view of an alternate embodiment of the actuation assembly of the hair trimmer.

An alternate embodiment of the present actuation assembly is shown in FIG. 9 and is generally designated 90. Common elements shared with the actuation assembly 24 are designated with identical reference numbers. In this embodiment, upon detachment of the blade assembly 16 from the actuation assembly 90 in at least one designated position, the blade assembly is configured for reattachment to the actuation assembly in the same at least one designated position.

Specifically, the actuation assembly 90 includes a mating rib 92, and a frame 94 defines a slot 96 constructed and arranged for receiving the mating rib. The frame 94 is similar to the frame 30, and is constructed and arranged for insertion into the blade housing 20 and for removable attachment to the actuation assembly 90. The actuation assembly 90 and frame 94 combination provides a "memory function" that enables the user to rotate the blade assembly 16 relative to the actuation assembly 90 to a desired position, detach the blade assembly, and reattach the blade assembly at the same desired position, because the frame 94 and the actuation assembly 90 will not mate with each other unless the mating rib 92 and the slot 96 are in alignment. Thus the unit has "memory" in that the position of the blade assembly 16 relative to the handle 12 is maintained after removal of the blade set.

This is unlike many current hair trimmers that have free rotation and as such no "memory" and/or require the user to rotate the blade assembly back to a starting position in order to detach the assembly. In such current hair trimmers, when the user reattaches the blade assembly, the blade assembly must be rotated back to an original or previous desired position. This step adds time to the hair styling process, and also decreases the accuracy of the hair trimmer if the desired rotatable position cannot be recreated or remembered upon reattachment of the blade assembly.

It is contemplated that the designated positions of detachment and reattachment are configured to correspond with the location of the sockets 46, although it is also recognized that the positions could be independent of the location of the sockets, depending on the application. Specifically, where the socket plate 44 includes four sockets 46, there are four designated positions located approximately 90° apart from each other. Further, as seen in FIG. 8, where the at least one socket plate 44 includes twelve sockets 46, there are twelve designated positions located approximately 30° apart from each other. Although twelve designated positions is most preferred, it is recognized that other configurations may be suitable, such as eight designated positions, where the sockets 46 are approximately 45° apart from corresponding adjacent sockets, depending on the application.

It is further contemplated that the actuation assembly 24 is constructed and arranged for receiving a variety of blade assemblies 16, 16*a* of varying blade size and shape. Accordingly, if the user operates the trimmer 10 and determines that a smaller blade assembly 16 is necessary (i.e., for trimming the nape of the neck), the current blade assembly is exchanged with the desired replacement blade assembly without the need to switch trimmers. Further, because of the memory capabilities discussed above in the alternate embodiment, the replacement blade assembly 16 can be attached to the actuation assembly 90 in the same rotatable location/position from which the original blade assembly was detached.

While a particular embodiment of the present hair trimmer has been described herein, it should be understood by those skilled in the art that changes and modifications may be made thereto without departing from the scope of the invention and as set forth in the claims listed below.

The invention claimed is:

1. A hair trimmer comprising:

a handle having a housing and a spring clip including at least one depending spring clip member, said housing including a peripheral surface and an actuation assembly rotatable 360 degrees relative to said housing to each of a plurality of releasably locked positions along said peripheral surface and defining a single plane of rotation; and a blade assembly including a reciprocating blade, a stationary blade and a blade assembly housing, said blade assembly housing constructed and arranged for being independently, detachably engaged to said actuation assembly for common rotation of said actuation assembly, said spring clip member being configured for securing said blade assembly housing to said actuation assembly, wherein when said blade assembly is engaged with said actuation assembly, said blade assembly is rotatable to a selected one of said plurality of releasably locked positions, wherein said actuation assembly includes a socket plate, a casing constructed and arranged for accommodating at least one detent assembly disposed to engage sockets in said socket plate upon rotation of said actuation assembly, and a spring ring located between said socket plate and said casing for biasing said actuation assembly against said blade assembly for positive engagement.

2. The hair trimmer of claim 1 wherein said casing includes at least one open-ended barrel being constructed and arranged for receiving a corresponding one of said at least one detent assembly.

3. The hair trimmer of claim 2 wherein each said detent assembly includes a pin and a spring constructed and arranged for biasing said pin towards an open end of said barrel.

4. A hair trimmer comprising:

a handle having a housing including a motor and an actuation assembly rotatable relative to said housing to a plurality of releasably locked positions and having a casing with at least two detent assemblies equally spaced from each other and engaging a fixed socket plate, each said detent assembly including a pin and a spring configured for biasing said pin and enabling rotation of said actuation assembly relative to said housing; and a blade assembly configured to be attached to said actuation assembly for common rotation relative to said handle housing, said blade assembly including a reciprocating blade, a stationary blade and a blade assembly housing;

said rotation of said blade assembly being defined by said plurality of releasably locked positions represented by engagement of said blade assembly with said casing.

5. A hair trimmer comprising:

a handle having a housing including a motor and an actuation assembly rotatable relative to said housing to a plurality of releasably locked positions and having a casing with at least two detent assemblies equally spaced from each other and engaging a fixed socket plate;

a blade assembly configured to be attached to said actuation assembly for common rotation relative to said handle housing, said blade assembly including a reciprocating blade, a stationary blade and a blade assembly housing;

said casing having at least two open-ended barrels for accommodating said at least two detent assemblies, and a spring ring located between said socket plate and said casing for retaining said blade assembly with said actuation assembly in a hook-and-catch mechanism; and said rotation of said blade assembly being defined by said plurality of releasably locked positions represented by engagement of said blade assembly with said casing.

6. The hair trimmer of claim 5 wherein said socket plate includes a plurality of equally spaced sockets, one of said sockets being located at each of said plurality of releasably locked positions, and wherein said at least two detent assemblies are configured for engaging said sockets upon rotation of said actuation assembly relative to said housing.

* * * * *